US009397409B2

(12) United States Patent
Larsen

(10) Patent No.: US 9,397,409 B2
(45) Date of Patent: Jul. 19, 2016

(54) ELECTRICAL CONNECTOR

(71) Applicant: METHODE ELECTRONICS, INC., Chicago, IL (US)

(72) Inventor: Russell G. Larsen, San Jose, CA (US)

(73) Assignee: METHODE ELECTRONICS, INC., Chicago, IL (US)

( * ) Notice: Subject to any disclaimer, the term of this patent is extended or adjusted under 35 U.S.C. 154(b) by 339 days.

(21) Appl. No.: 13/803,209

(22) Filed: Mar. 14, 2013

(65) Prior Publication Data

US 2014/0273664 A1 Sep. 18, 2014

(51) Int. Cl.

| | |
|---|---|
| ***H01R 4/10*** | (2006.01) |
| ***H01R 4/18*** | (2006.01) |
| ***H01R 13/11*** | (2006.01) |

(52) U.S. Cl.

CPC ..... *H01R 4/184* (2013.01); *H01R 4/183* (2013.01); *H01R 13/112* (2013.01)

(58) Field of Classification Search

CPC ..... H01R 13/112; H01R 4/183; H01R 4/184

USPC ..... 439/442, 585, 730, 741, 877, 879, 882, 439/424, 423, 203, 862

See application file for complete search history.

(56) References Cited

U.S. PATENT DOCUMENTS

| | | | | |
|---|---|---|---|---|
| 3,656,093 | A * | 4/1972 | Kinkaid | 439/882 |
| 4,932,906 | A * | 6/1990 | Kaley et al. | 439/857 |
| 8,182,299 | B2 * | 5/2012 | Schrader | 439/857 |
| 2001/0019926 | A1 * | 9/2001 | Natali | H01R 4/48 439/862 |
| 2010/0184340 | A1 * | 7/2010 | Paagman et al. | 439/882 |

OTHER PUBLICATIONS

Tyco Electronics Catalog 1773096, pp. 198-204 (Feb. 2010).

Methode Electronics, Inc. Data Sheet for Power Swivel Nut (undated, shows product that was on sale more than one year before the filing date of the present application).

* cited by examiner

*Primary Examiner* — Felix O Figueroa

(74) *Attorney, Agent, or Firm* — Barnes & Thornburg LLP

(57) ABSTRACT

An electrical connector adapted for connection to a bus bar includes a dielectric housing, a conductive insert, and a cable interface. The cable interface may include a cable crimp lug and clinch nut, a combined cable crimp and crimp nut, or an integral cable crimp.

20 Claims, 10 Drawing Sheets

ELECTRICAL CONNECTOR

BACKGROUND AND SUMMARY

The present disclosure is directed generally to electrical connectors. More particularly, the disclosure is directed to electrical connectors that interface with bus bars and cables.

Electrical equipment cabinets, for example, data distribution centers and motor control centers, often include continuous length conductor bars (sometimes referred to herein as bus bars) that provide power for equipment mounted in and/or powered from the cabinet. The electrical interface between the bus bar and equipment typically includes an electrical connector configured to clip onto the bus bar. The connector often is rigidly mounted to an equipment drawer or the like disposed in the cabinet, such that the connector becomes engaged with the bus bar when the drawer is fully inserted into the cabinet and disengaged from the bus bar when the drawer is withdrawn from the fully inserted position. When the connector is rigidly mounted, any misalignment of the connector with the bus bar can make it difficult to reinsert the drawer and reengage the connector with the bus bar. Efforts have been made to mount such connectors with a restricted amount of float to provide some degree of self alignment with the bus bar. Such efforts, however, have had limited success.

The present disclosure sets forth three illustrative embodiments of a bus bar connector that interfaces with a cable or other flexible conductor (the terms "cable" and "flexible conductor" may be used interchangeably herein). The flexible nature of the conductor allows the connector to "float" with respect to the bus bar, thereby facilitating engagement of the connector with the bus bar.

DETAILED DESCRIPTION OF THE DRAWINGS

Figure 1:
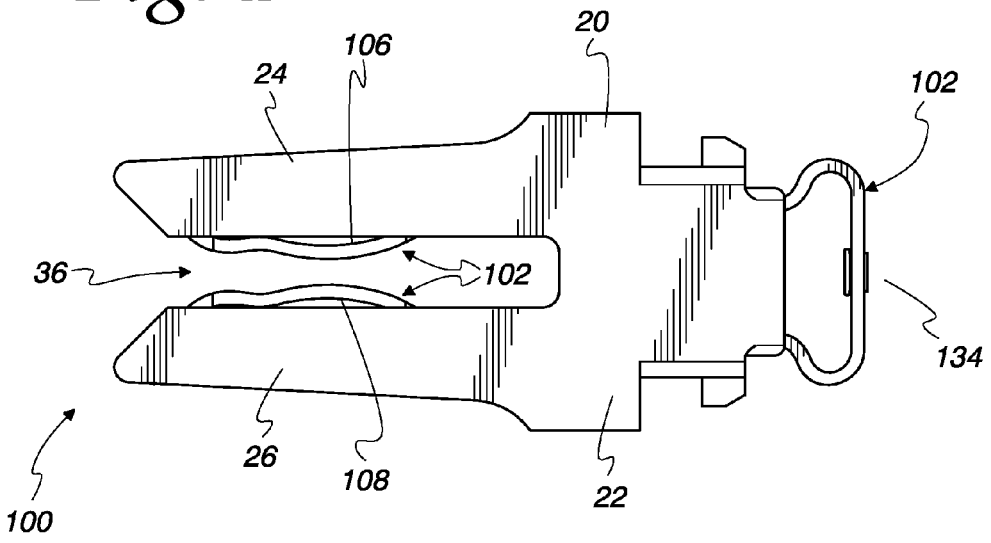
FIG. 1 is a side elevation view of a first exemplary embodiment of an electrical connector 100 configured to interface with a bus bar 50 and a crimp lug 150.
Figure 2:
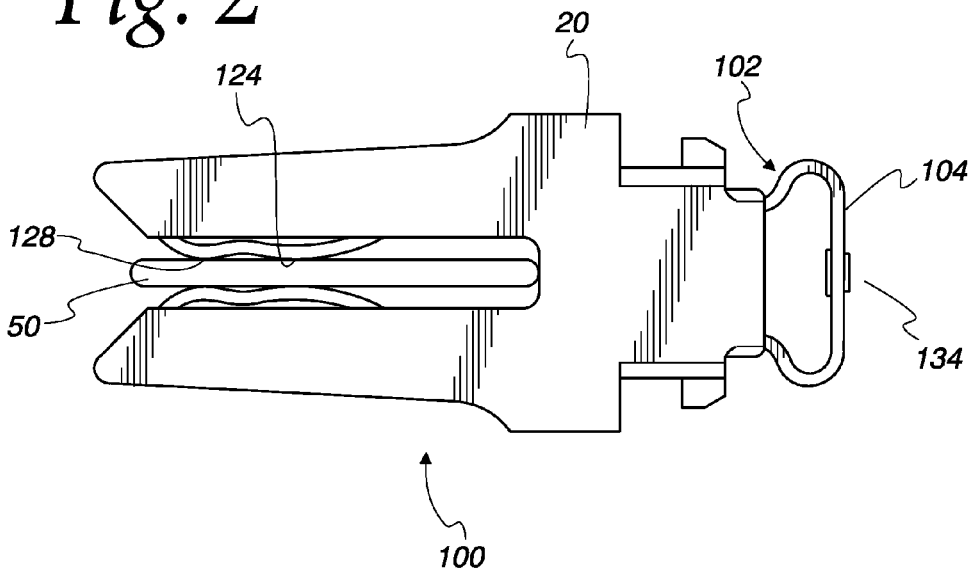
FIG. 2 is a side elevation view of connector 100 attached to bus bar 50.
Figure 3A:
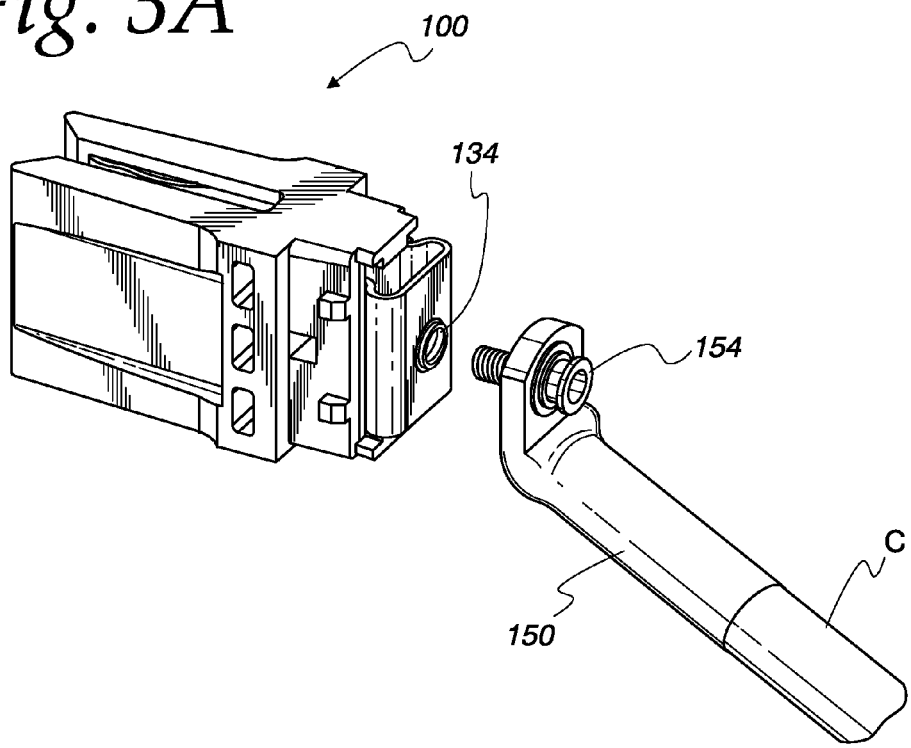
FIG. 3A is a perspective view of connector 100 and a cable C terminated to a crimp lug 150.
Figure 3B:
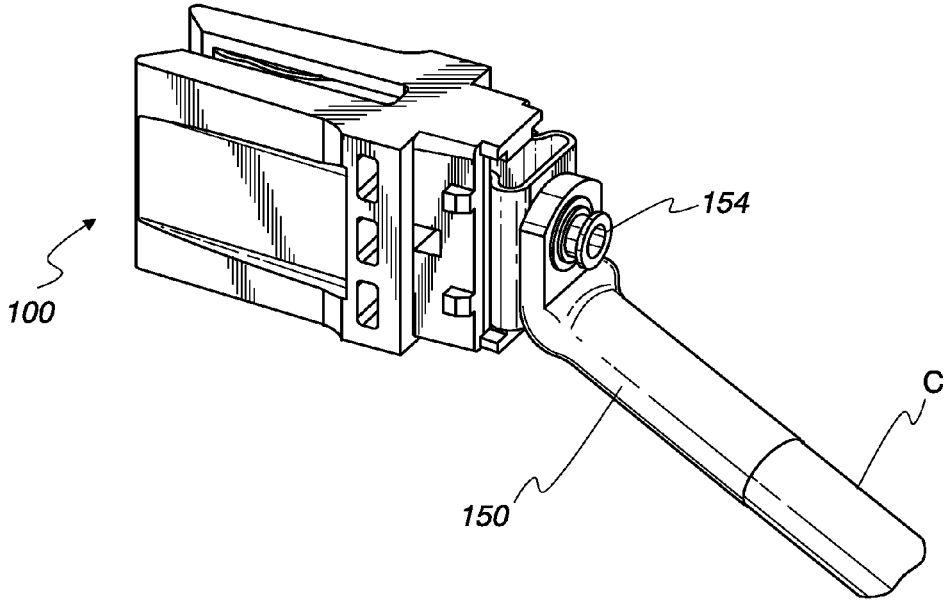
FIG. 3B is a perspective view of connector 100 and cable C terminated to a crimp lug 150, which is attached to connector 100.
Figure 4:
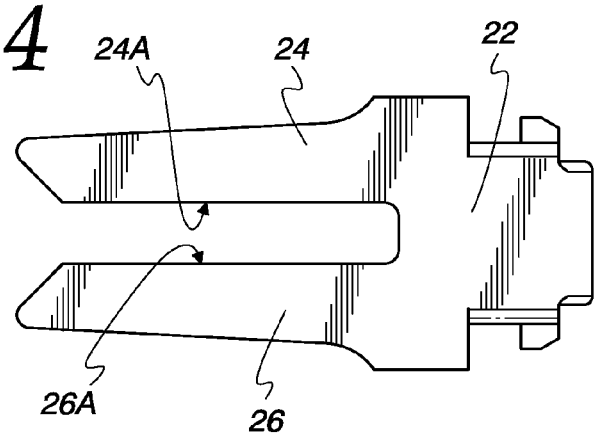
FIG. 4 is a side elevation view of housing 20 of connector 100.
Figure 5:
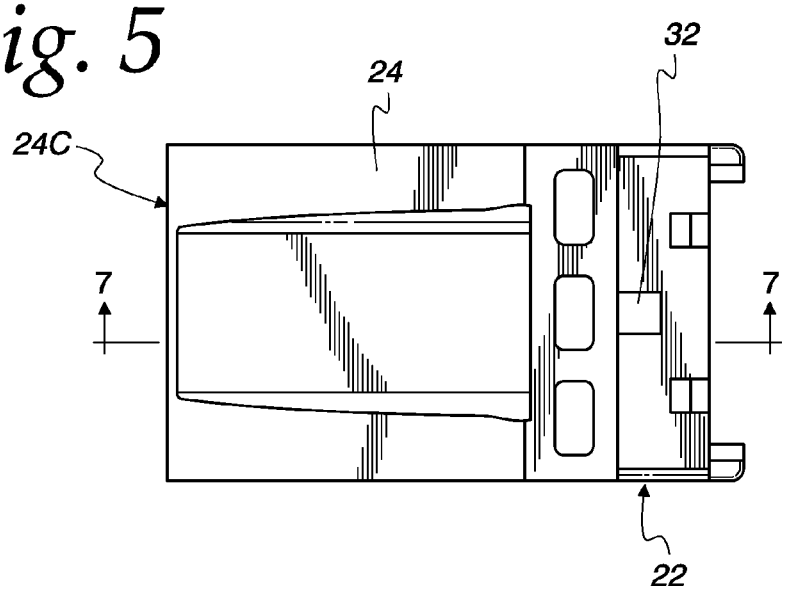
FIG. 5 is a top plan view of housing 20.
Figure 6:
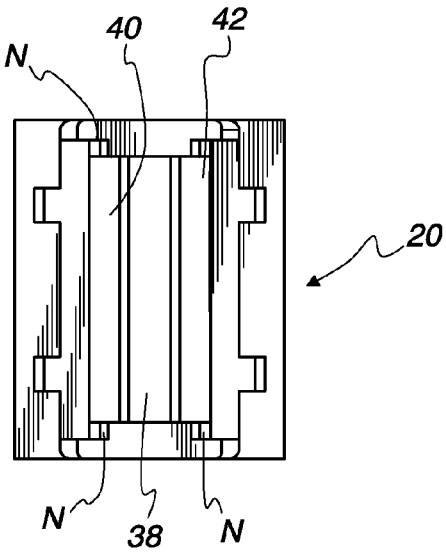
FIG. 6 is an end view of housing 20.
Figure 7:
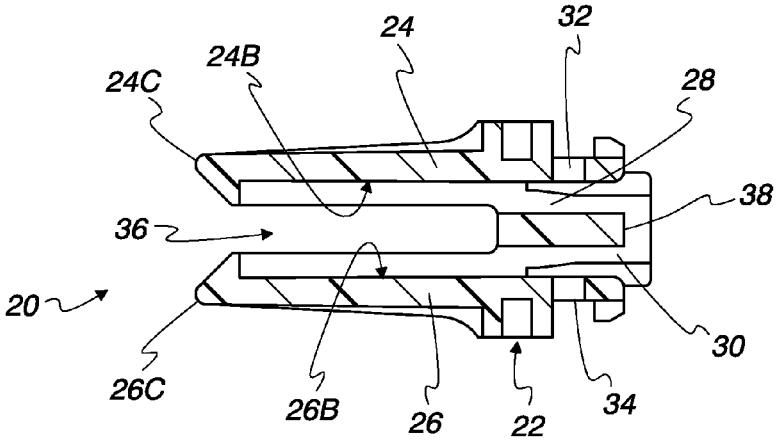
FIG. 7 is a side cross-sectional view of housing 20.
Figure 8:
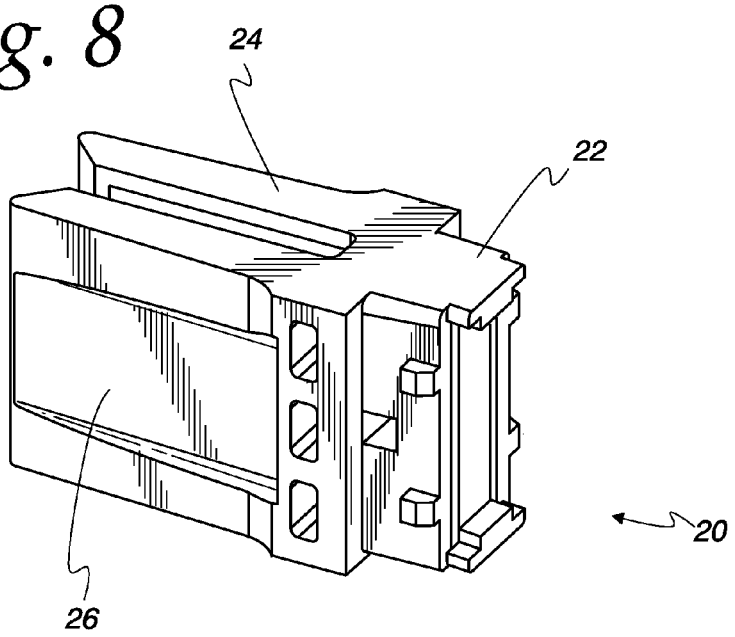
FIG. 8 is a perspective view of housing 20.
Figure 9:
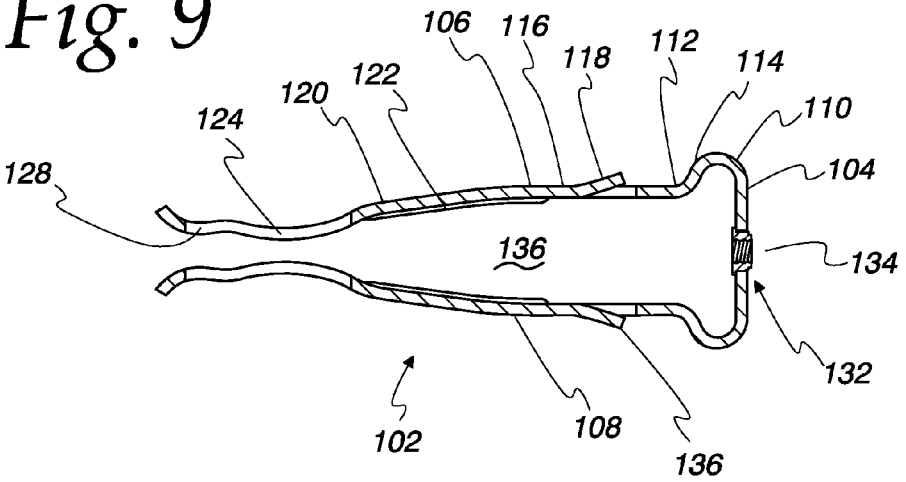
FIG. 9 is a side cross-sectional view of conductive insert 102 of connector 100.
Figure 10:
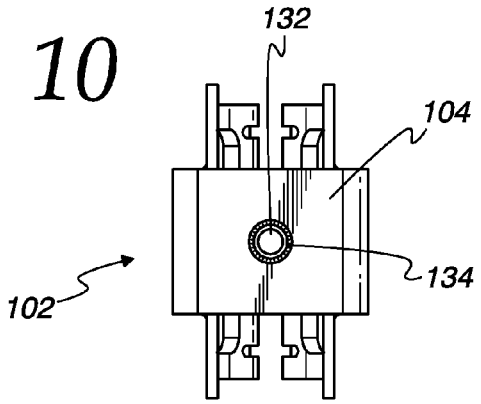
FIG. 10 is an end elevation view of conductive insert 102 of connector 100.
Figure 11:
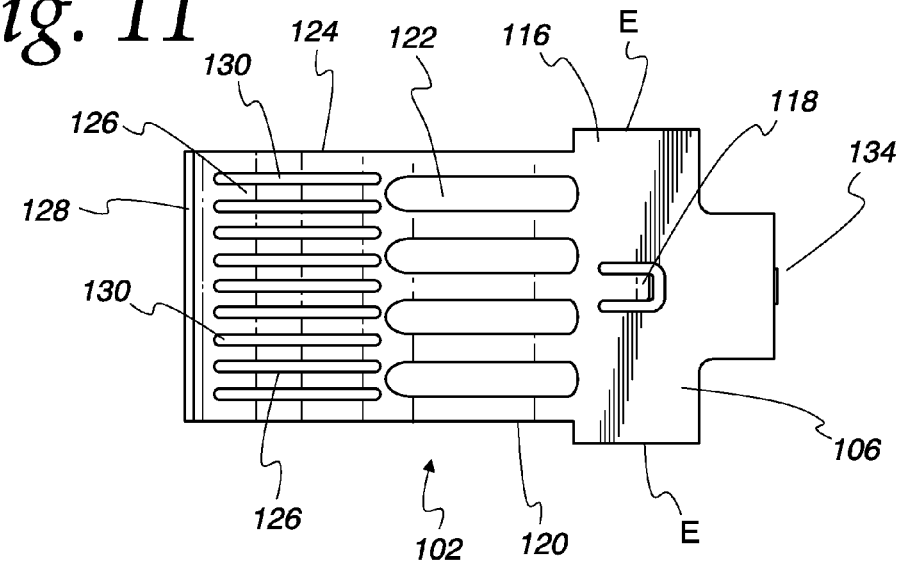
FIG. 11 is a plan view of conductive insert 102 of connector 100.
Figure 12A:
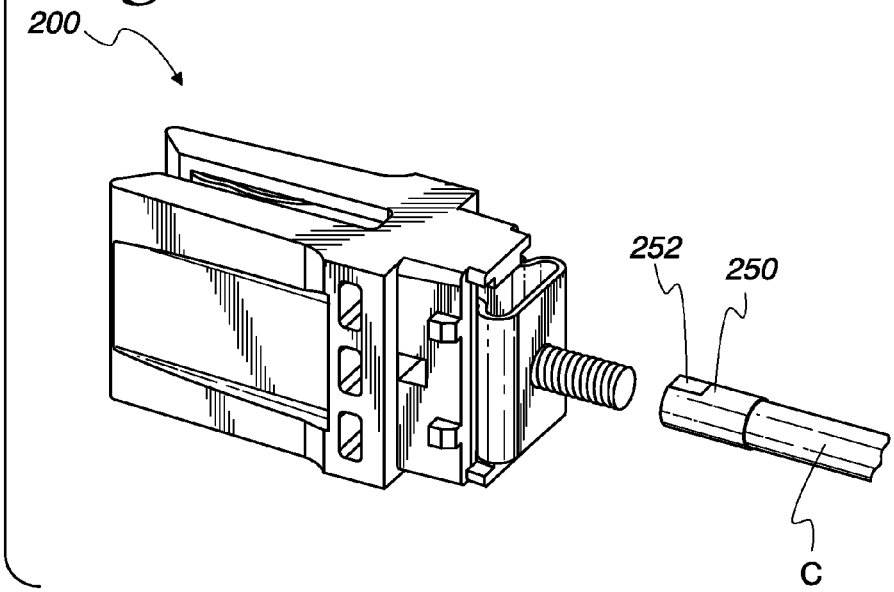
FIG. 12A is a perspective view of a second embodiment of an electrical connector 200 configured to interface with bus bar 50 and a crimp nut 250 terminated to cable C.
Figure 12B:
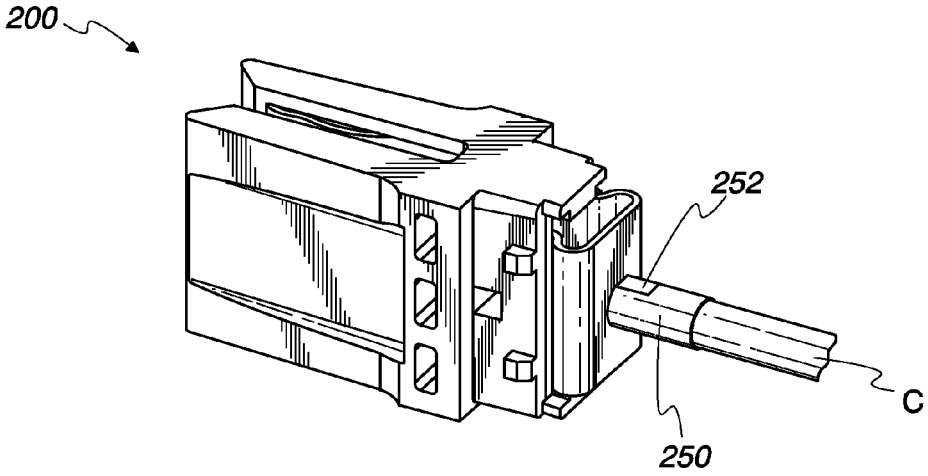
FIG. 12B is a perspective view of connector 200 and cable C terminated to crimp nut 250, which is attached to connector 200.
Figure 13:
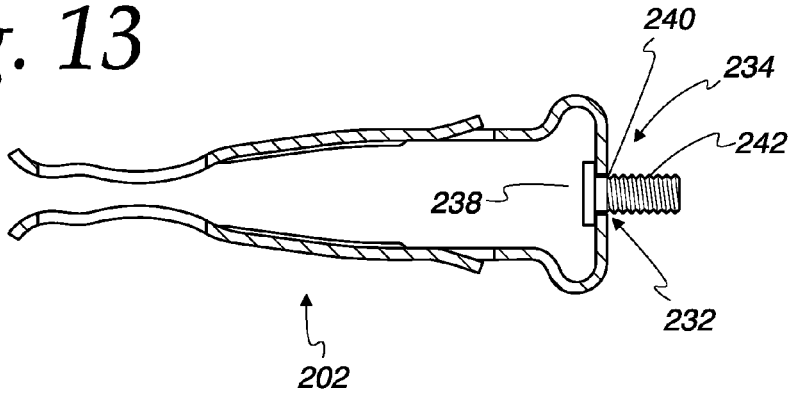
FIG. 13 is a side cross-sectional view of conductive insert 202 of connector 200.
Figure 14:
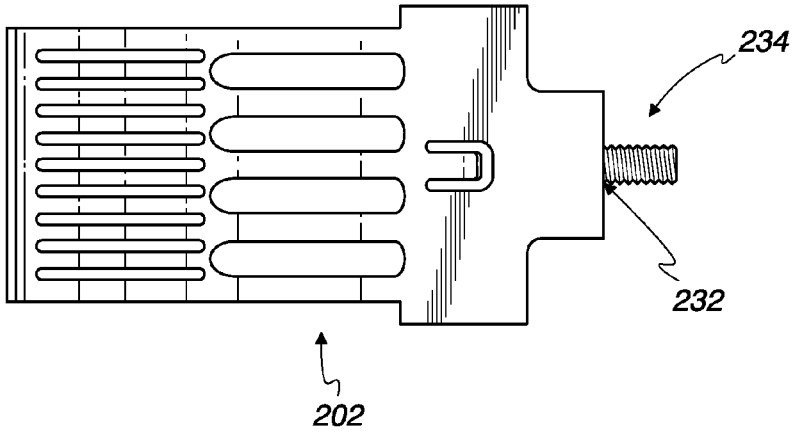
FIG. 14 is a plan view of conductive insert 202 of connector 200.
Figure 15:
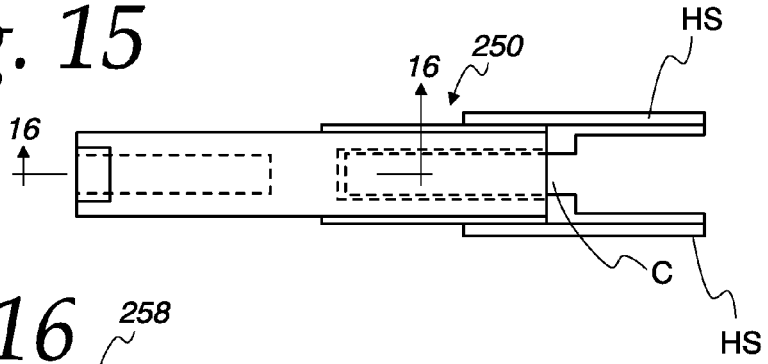
FIG. 15 is a side elevation view of cable C terminated to crimp nut 250 with heat shrink HS covering the termination.
Figure 16:
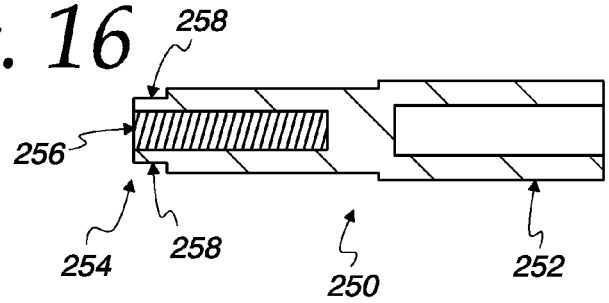
FIG. 16 is a side cross-sectional view of crimp nut 250.
Figure 17A:
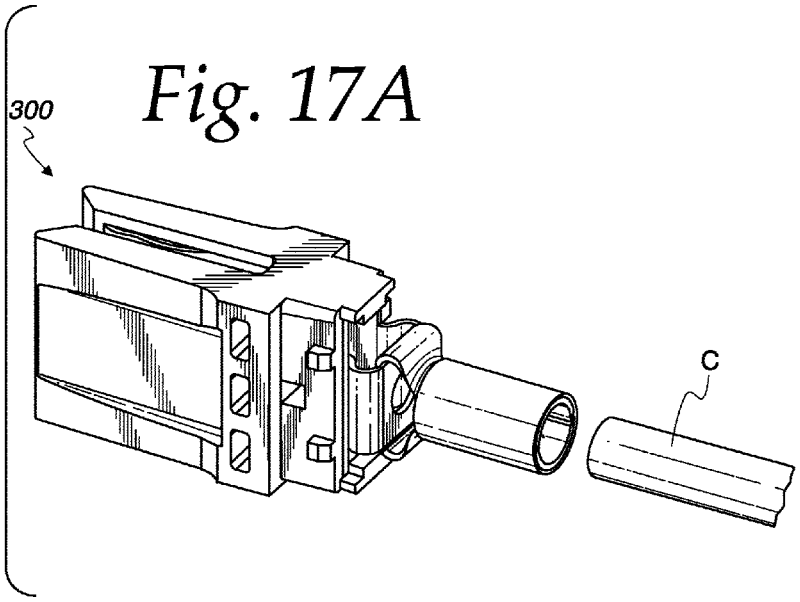
FIG. 17A is a perspective view of a third embodiment of an electrical connector 300 configured to interface with bus bar 50 and cable C.
Figure 17B:
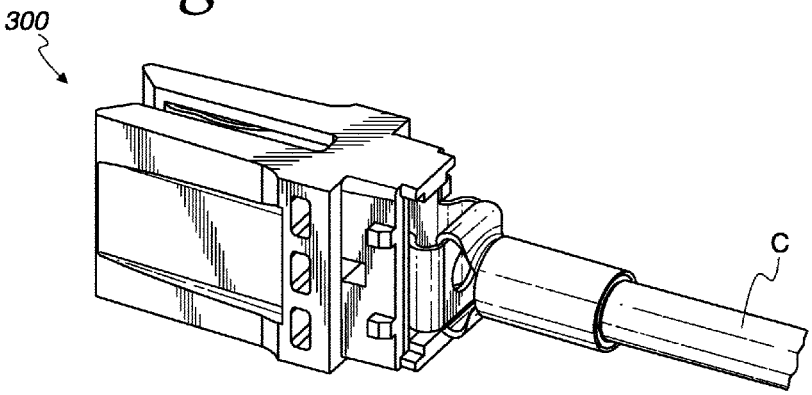
FIG. 17B is a perspective view of connector 300 and cable C terminated thereto.
Figure 18:
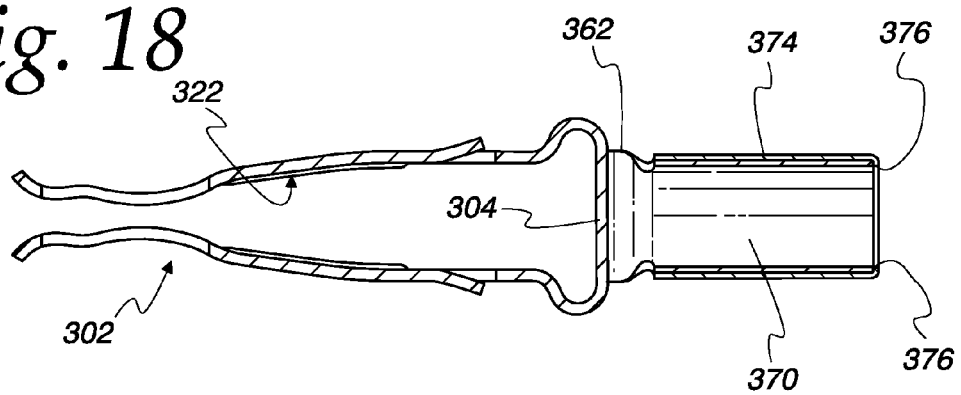
FIG. 18 is a side cross-sectional view of conductive insert 302 of connector 300.
Figure 19:
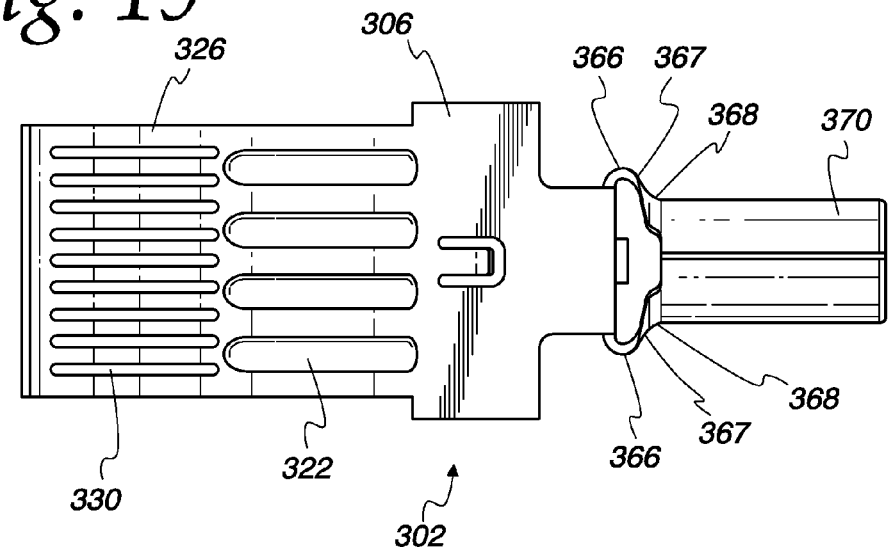
FIG. 19 is a plan view of conductive insert 302 of connector 300.

FIGS. 1-11 illustrate a first exemplary embodiment of an electrical connector 100. Connector 100 includes a generally U-shaped housing 20 having a base 22 and first and second legs 24, 26 depending generally perpendicularly from a first end of base 22. Base 22 and first and second legs 24, 26 thereby cooperate to define an interior region 36 of housing 20 adapted to receive a bus bar 50 or other mating connector element, as will be discussed further below.

First and second legs 24, 26 are generally parallel to each other. Each of first and second legs 24, 26 defines a surface 24A, 26A facing interior region 36 of housing 20. Surfaces 24A, 26A are substantially parallel to each other. Each of first and second legs 24, 26 further defines a surface 24B, 26B recessed from corresponding surface 24A, 26A. Surfaces 24B, 26B are configured to receive and cooperate with a conductive insert 102, as will be discussed further below. The surface of each of legs 24, 26 facing interior region 36 is beveled adjacent the free end or leading edge 24C, 26C thereof. The beveled configuration of free ends 24C, 26C facilitates receipt of bus bar 50 therebetween, as would be understood by one skilled in the art.

Base 22 of housing 20 defines first and second channels 28, 30. Each of first and second channels 28, 30 extends from the first end of base 22 through to the opposite, free end of base 22, where it terminates in a corresponding, generally rectangular, end opening 40, 42. So configured, each of first and second channels 28, 30 communicates with the interior region of housing 20 between first and second legs 24, 26. Each of first and second channels 28, 30 is generally rectangular and can span nearly the entire width of base 22 or some lesser width. The width of channels 28, 30 typically would be dictated by the structural limitations of housing 20 and the geometry of insert 102, as discussed below and as would be understood by one skilled in the art.

A divider 38 separates first channel 28 from second channel 30. In some embodiments, a single, larger channel could take the place of first and second channels 28, 30, as would be recognized understood by one skilled in the art. In such embodiments, divider 38 would be omitted. Also, a single end opening would take the place of first and second end openings 40, 42.

Base 22 defines four notches N extending inwardly from second end of base. Notches N are configured to receive ears E of insert 102, as will be discussed further below. Notches N and ears E cooperate to limit the extent to which insert 102 can be inserted into base 22.

Base 22 also defines first and second tab receiving holes 32, 34. First tab receiving hole 32 extends from an exterior surface of base 22 through to an interior surface of base 22, such that first hole 32 communicates with first channel 28. Similarly, second hole 34 extends from an opposing exterior side surface of base 22 through to an opposing interior surface of base 22, such that second hole 34 communicates with second channel 30. In other embodiments, first and second holes 32, 34 could be disposed through first and second legs 24, 26 respectively, instead of through base 22. In such embodiments, holes 32, 34 could communicate with interior region 36 of housing 20, rather than with channels 28, 30. In further embodiments, first and second holes 32, 34 could be embodied as cavities extending outwardly from corresponding interior portions of housing 20 (for example, outwardly from channels 28, 30 or from the surfaces of legs 24, 26 facing interior region 36) toward, but not through to, corresponding exterior portions of housing 20. Housing 20 may be made of plastic or another suitable dielectric material.

Connector 100 also includes a generally U-shaped conductive insert or conductive element 102 having a base 104 and first and second legs 106, 108 depending from base 104. Base 104 defines a hole 132. Hole 132 may, but need not be centered with respect to the area of base 104. In some embodiments, hole 132 may be internally threaded and thereby adapted to receive a mating threaded fastener, as will be discussed further below. In other embodiments, an internally threaded clinch nut 134 could be inserted within hole 132 and secured to base 104, as would be understood by one skilled in the art. In embodiments using clinch nut 134, hole 132 need not be threaded.

First leg 106 depends from base 104 via a first bend 110 of about 135° from the plane of base 104, and a second bend 112 of about 45° directed away from first bend 110 and base 104. A land 114 may be located between first bend and second bend 110, 112. In other embodiments, first and second bends 110, 112 may have other angles, as would be understood by one skilled in the art.

A first transition region 116 extends from second bend 112. Based on the foregoing bend configuration, first transition region 116 is generally perpendicular to base 104. In other embodiments, first transition region 116 could be oriented other than perpendicular to base 104.

First transition region 116 defines a tab 118. Tab 118 is illustrated as being cut from first transition region 118 and bent outwardly therefrom. Tab 118 could be formed in other ways, as would be recognized by one skilled in the art. Tab 118 is configured to engage with first tab receiving hole 32 in housing 20, as discussed above and as will be discussed further below.

Ears E extend laterally from first transition region 116. Ears E cooperate with notches N in housing 20 to limit the extent to which insert 102 may be inserted into base 22, as will be discussed further below.

A second transition region 120 extends from first transition region 116. Second transition region 120 is canted inwardly toward interior region 136 of insert 102.

First and/or second transition region 116, 120 may be provided with one or more stiffening ribs 122. Where provided, stiffening ribs 122 may extend generally across the length of either or both of first and second transition regions 116, 120 or across a lesser extent of either or both of first and second transition regions 116, 120. Stiffening ribs 122 may increase the rate of spring force imparted by first leg 106 on bus bar 50 when connector 100 is attached thereto, as would be understood by one skilled in the art. Stiffening ribs 122 may be formed by stamping or another suitable technique, as would be understood by one skilled in the art. Stiffening ribs 122 could be omitted in some embodiments.

A first contact area 124 having a first end and a second end extends from second transition region 120. First contact area 124 is bowed inwardly between the first and second ends thereof toward interior region 136 of insert 102. First contact area 124 may define a plurality of individual contact fingers 126 defined by a set of intervening slots 130. The illustrated embodiment includes ten contact fingers 126. Other embodiments may include more or fewer contact fingers 126, as would be understood by one skilled in the art. Indeed, first contact area 124 could be embodied as a solid surface. Where provided, contact fingers 126 and slots 130 may be formed by cutting, stamping, or any other suitable technique. First contact area 124 (whether embodied as a solid surface or in the form of plural contact fingers 126) is configured to compressively engage with bus bar 50, as will be discussed further below.

An optional second contact area 128 extends from first contact area 124. Second contact area 128 arcs outwardly from first contact area 124 to the free end of first leg 106. The free end of first leg 106 may, but need not, bear against recessed surface 24B of first leg 24 of housing 20 when insert 102 is assembled to housing 20, as discussed further below. Where provided, second contact area 128 facilitates hot plugging of connector 100 onto bus bar 50, as would be understood by one skilled in the art.

Second leg 108 as illustrated is configured as the mirror image of first leg 106. In other embodiments, the configuration of second leg 108 could deviate from that of first leg 106 in various respects. For example, second leg 108 need not include tab 118. Second leg 108 could differ from first leg 106 in other ways, as well.

Insert 102 could be made of any material having suitable electrical and structural characteristics. For example, insert 102 could be made of copper, steel or another metal.

Insert 102 could be assembled to housing 20 by inserting the free ends of first and second legs 106, 108 of insert 102, respectively, through first and second end openings 40, 42 and into first and second channels 28, 30 of housing 20. Insert 102 could be further pressed into housing 20 until tab 118 of first leg 106 (and the corresponding tab of second leg 108, if provided) engages with tab receiving holes 32, 34 in the sides of housing 20. Notches N of housing 20 and ears E of insert 102 cooperate to limit the extent to which insert 102 can be inserted into housing 20. Notches N, ears E, first hole 32, and tab 118 (as well as second hole 34 and tab 136 of second leg 108, where provided) cooperate to secure insert 102 to housing 20 once assembled together.

Connector 100 could be used in connection with, for example, a crimp lug 150 configured to be crimped onto a cable C and having a hole (not shown, obscured by fastener 154) for receiving a threaded fastener 154, as would be known to one skilled in the art. Crimp lug 150 could be attached to base 104 of insert 102 by inserting threaded fastener 154 through hole 152 in crimp lug 150 and threading fastener 154 into clinch nut 134 or threaded hole 132 of base 104.

Connector 100 could be attached to bus bar 50 by pressing connector 100 onto bus bar 50 so that bus bar 50 is received within the interior regions of housing 20 and insert 102. The beveled leading edges 24C, 26C of first and second legs 24, 26 of housing 20 can facilitate receipt of bus bar 50 between first and second legs 24, 26. Similarly, the arced free ends of first and second legs 106, 108 of insert 100 can facilitate receipt of bus bar 50 between first and second legs 106, 108.

As bus bar 50 enters the interior region of insert 100, bus bar 50 contacts and deflects or otherwise engages with second contact area 128. Typically, such mating of bus bar 50 with second contact area 128 would cause the free ends of first and second legs 106, 108 to contact the corresponding recessed surfaces 24B, 26B of legs 24, 26 of housing 20, if not already in contact therewith.

As connector 100 is further pressed onto bus bar 50, bus bar 50 contacts and deflects or otherwise engages with first contact area 124. Connector 100 may be pressed onto bus bar 50 until bus bar 50 bottoms out against the first side of base 22 of housing 20.

When connector 100 is attached to bus bar 50 as discussed above, first and second legs 106, 108 of insert 102 cooperate to compressively engage with bus bar 50. So attached, first contact areas 124 and/or second contact areas 128 of first and second legs 106, 108 typically would cooperatively impart sufficient compressive force on bus bar 50 so that connector 100 remains attached to bus bar 50 until intentionally disengaged therefrom. Connector 100 may be removed from bus bar 50, for example, by grasping housing 20 and pulling it (and, therefore, insert 102) from bus bar 50.

FIGS. 12-16 illustrate a second exemplary embodiment of an electrical connector 200. Connector 200 includes a housing 20 identical to housing 20 of connector 100. Connector 200 also includes a conductive insert 202 disposed within housing 20. Insert 202 is identical to insert 102, with the following exception.

In place of the threaded hole 132 or clinch nut 134 of insert 102, insert 202 includes a hole 232 and a stud 234 inserted therethrough. Stud 234 includes a head 238, a shank 240, and a threaded portion 242. Stud 234 is inserted through hole 232 such that head 238 faces housing 20 and threaded portion 242 extends away from housing 20. Shank 240 may be press fit into hole 232 so as to secure stud 234 to insert 202 such that stud 234 does not freely rotate with respect to insert 102. Stud 234 may be secured to insert 202 in other ways, as well.

Connector 200 is configured for use with a crimp nut 250. Crimp nut 250 is generally cylindrical. Crimp nut 250 includes a crimp end 252 and a nut end 254 joined to and extending axially away from crimp end 252. Nut end 254 defines an internally threaded hole 256 configured to receive stud 234 in threaded engagement. Flats 258 are provided on the exterior surface of nut end 254. Flats 258 are configured to receive a wrench that may be used to torque crimp nut 250 to stud 234, as would be understood by one skilled in the art.

Crimp end 252 is generally annular and has a wall thickness and diameter configured to receive and be crimped to a cable C of predetermined size. Crimp end 252 may be crimped to cable C using a compression crimp, a four-sided dimple crimp, or another suitable form of crimp. The inner and outer diameters (and, therefore, the wall thickness) of crimp end 252 can be adapted as necessary to accommodate the desired cable size. Crimp end 252 and nut end 254 may, but need not, have different inside and outside diameters.

Connector 200 could be used by terminating cable C to crimp end 252 of crimp nut 250 as would be understood by one skilled in the art. An insulative heat shrink HS could be applied over the foregoing termination, as would be understood by one skilled in the art. Crimp nut 250 could be attached to insert 202 by threading stud 234 into nut end 254 of crimp nut 250 and torquing the two components together. Connector 200 could be attached to bus bar 50 as discussed above in connection with connector 100.

FIGS. 17A-22 illustrate a third exemplary embodiment of an electrical connector 300.

Connector 300 includes a housing 20 identical to housing 20 of connector 100. Connector 300 also includes a conductive insert 302 disposed within housing 20. Insert 302 is in most respects identical to insert 102. For example, insert 302 includes first and second legs 306, 308, which may be identical to first and second legs 106, 108. Also, insert 302 may include stiffening ribs 322, which may be identical to stiffening ribs 122. Further, insert 302 may include contact fingers 326 defined by intervening slots 330, which may be identical to contact fingers 126 defined by intervening slots 130.

Insert 302 differs from insert 102 as follows. Whereas base 104 is about the same width as first and second legs 106, 108, base 304 is considerably narrower than first and second legs 306, 308. Also, whereas base 104 defines hole 132, base 304 need not include such a hole (although it could).

Unlike insert 102, insert 302 includes a first crimp ear 362 and a second crimp ear 364 depending from base 304 in an opposite direction from first and second legs 306, 308. First crimp ear 362 depends from base 304 via a third bend 366 of about 135° from the plane of base 304, and a fourth bend 368 of about 45° directed away from third bend 366 and base 304. A land 367 may be located between third bend 366 and fourth bend 368. In other embodiments, third and fourth bends 366, 368 may have other angles, as would be understood by one skilled in the art. The width of first crimp ear 362 may taper between third bend 366 and fourth bend 368 such that first crimp ear 362 is narrower proximate fourth bend 368 than it is proximate third bend 366.

Figure 20:
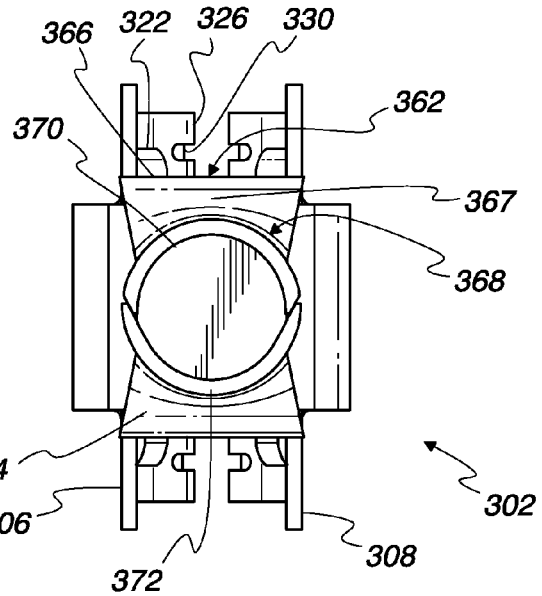
FIG. 20 is an end view of conductive insert 302 of connector 300.
Figure 21:
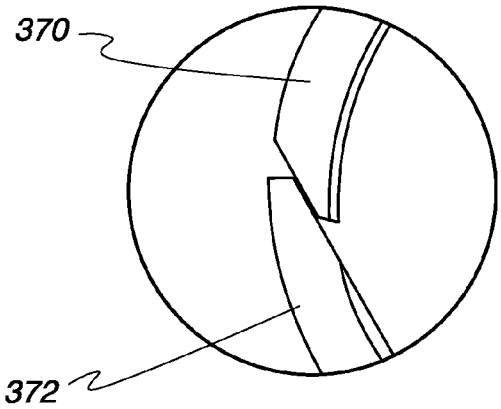
FIG. 21 is a detail view of a portion of conductive insert 302 of connector 300.
Figure 22:
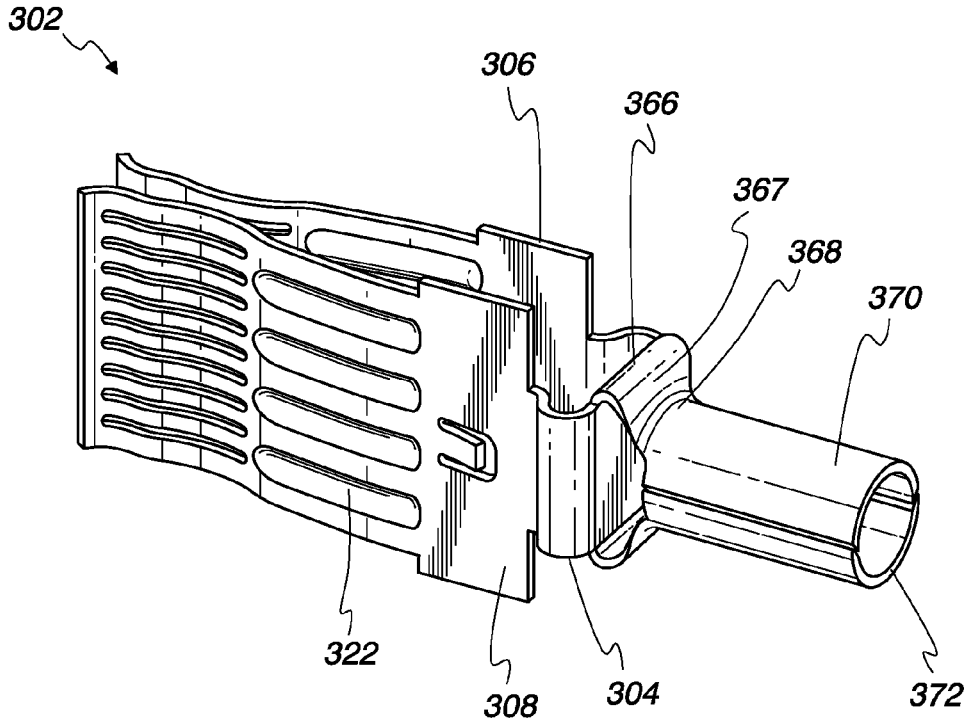
FIG. 22 is a perspective view of conductive insert 302 of connector 300.

A first crimp half barrel 370 extends from fourth bend 368 of first crimp ear 362. First crimp half barrel 370 has a substantially semi-annular form. As best illustrated in FIGS. 20 and 21, the free side edges of first crimp half barrel 370 are tapered.

Second crimp ear 364 generally is the mirror image of first crimp ear 362. As such, second crimp ear 364 defines a second crimp half barrel 372 similar to first crimp half barrel 370. Like the free side edges of first crimp half barrel 370, the free side edges of second crimp half barrel 372 are tapered. The tapers at the free side edges of second crimp half barrel 372, however, are the reverse of the tapers at the free side edges of first crimp half barrel 370. This configuration allows the free side edges of second crimp half barrel 372 to overlap the free side edges of first crimp half barrel 370. In some embodiments, the foregoing tapers could be omitted.

Reference herein to crimp half barrels 370, 372 as such should not be construed to mean that first and second crimp half barrels 370, 372 need to define substantially, or less than substantially, one half of a barrel section. Indeed, either or both of first and second crimp half barrels 370, 372 could define substantially more or less than one half of a barrel section. In such embodiments, first and second crimp half barrels 370, 372 could overlap to a greater degree than shown and described above, or not at all.

As illustrated, first and second crimp half barrels 370, 372 cooperate to form an annulus. In other embodiments, first and second crimp half barrels 370, 372 could cooperate to form a lesser portion of an annulus. The annulus (or partial annulus) formed by first and second crimp half barrels 370, 372 defines an interior region configured to receive an electrical cable, as discussed further below.

An outer barrel 374 is disposed about first and second crimp half barrels 370, 372. Outer barrel 374 is generally annular. Outer barrel 374 includes a lip 376 extending inwardly about the inner circumference of outer barrel 374. Lip 376 preferably has a width equal to or slightly greater than the thickness of first and second crimp half barrels 370, 372, such that the inner edge of lip 376 is proud of the inner surfaces of first and second crimp half barrels 370, 372. This configuration facilitates insertion of a cable C into outer barrel 374 and the interior region of the annulus formed by first and second crimp half barrels 370, 372. Outer barrel 374 may joined to first and second crimp half barrels 370, 372 by means of an interference fit, as would be understood by one skilled in the art.

Connector 300 could be used by inserting the bare end of a cable C into outer barrel 374 and first and second crimp half barrels 370, 372 and then crimping outer barrel 374 and first and second crimp half barrels 370, 372 onto cable C. In the illustrated embodiment, the tapered free side edges of first and second crimp half barrels 370, 372 may facilitate compression of first and second crimp half barrels against, or with respect to, each other. An insulative heat shrink HS could be applied to the foregoing termination, as would be understood by one skilled in the art. Connector 300 could be attached to bus bar 50 as discussed above in connection with connector 100.

In some embodiments, housing 20 could be omitted from any of connectors 100, 200 and 300.

The embodiments illustrated and described herein are exemplary. One skilled in the art would recognize how to modify these exemplary embodiments without departing from the scope of the appended claims. As such, the exemplary embodiments should not be construed as limiting the scope of the appended claims.

The invention claimed is:

1. An electrical connector comprising:

a conductive element, said conductive element comprising:

a generally planar base;

a first leg extending from said base by a first bend and a second leg extending from said base by a second bend opposite said first bend, wherein said base, said first leg, and said second leg cooperate to define a first interior region;

a first crimp ear extending from said base by a third bend, said first crimp defining a first crimp half barrel, and a second crimp ear extending from said base by a fourth bend, said second crimp ear defining a second crimp half barrel, wherein said first crimp ear and said second crimp ear cooperate to define a second interior region; and wherein said third bend and said fourth bend are not parallel to said first bend and said second bend.

2. The electrical connector of claim 1, wherein said third bend and said fourth bend are generally perpendicular to said first bend and said second bend.

3. The electrical connector of claim 1, said first bend having a first bend axis, said second bend having a second bend axis, said third bend having a third bend axis, and said fourth bend having a fourth bend axis, wherein said third bend axis and said fourth bend axis extend in directions generally perpendicular to said first bend axis and said second bend axis.

4. The electrical connector of claim 1 further comprising an outer barrel disposed about said first and second crimp half barrels.

5. The electrical connector of claim 4 wherein said outer barrel is substantially annular.

6. The electrical connector of claim 5, said outer barrel comprising a lip extending radially inwardly from an end thereof, said lip being proud of inner surfaces of said first crimp half barrel and said second crimp half barrel.

7. The electrical connector of claim 1 further comprising a dielectric housing, at least a portion of said conductive element received by said housing.

8. The electrical connector of claim 7, said conductive element further comprising at least one tab and said housing defining at least one tab receiving hole.

9. The electrical connector of claim 1 wherein said first crimp half barrel and said second crimp half barrel cooperate to form an annulus.

10. The electrical connector of claim 1 wherein said first crimp half barrel comprises first and second free side edges and said second crimp half barrel comprises first and second free side edges, and wherein said first and second free side edges of said second crimp half barrel overlap said first and second free side edges of said first crimp half barrel.

11. The electrical connector of claim 10 wherein said first and second free side edges of said first crimp half barrel and said first and second free side edges of said second crimp half barrel are tapered.

12. The electrical connector of claim 1 wherein said conductive element is formed from a single piece of material.

13. The electrical connector of claim 12 wherein said first and second legs and said first and second crimp half barrels are bent from said base.

14. The electrical connector of claim 1 wherein each of said first leg and said second leg comprises a plurality of contact areas adapted to compressively engage with said mating connector element.

15. The electrical connector of claim 1, wherein at least one of said first leg and said second leg comprises at least one stiffening rib.

16. The electrical connector of claim 1 wherein each of said first and said second leg comprises a first contact area.

17. The electrical connector of claim 16 wherein at least one of said first contact areas comprises a plurality of contact fingers defined by intervening slots.

18. The electrical connector of claim 16 wherein each of said first leg and said second leg further comprises a second contact area.

19. The electrical connector of claim 18, wherein each of said second contact area arcs outwardly from a corresponding one of said first contact areas.

20. The electrical connector of claim 18, wherein each of said second contact area is further from said base than a corresponding one of said first contact areas.

* * * * *